US006204231B1

(12) United States Patent
Patten et al.

(10) Patent No.: US 6,204,231 B1
(45) **Date of Patent: *Mar. 20, 2001**

(54) CLEANING AGENT FOR FOOD-INDUSTRY FACILITIES, ITS USE AND METHOD OF CLEANING SUCH FACILITIES USING THE AGENT

(75) Inventors: Anja Patten, Leichlingen; Ralf Krack, Duesseldorf; Dietmar Rossner, Hilden, all of (DE)

(73) Assignee: Henkel Kommandigesellschaft Auf Aktien, Duesseldorf (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/142,098

(22) PCT Filed: Feb. 20, 1997

(86) PCT No.: PCT/EP97/00799

§ 371 Date: Sep. 1, 1998

§ 102(e) Date: Sep. 1, 1998

(87) PCT Pub. No.: WO97/32000

PCT Pub. Date: Sep. 4, 1997

(30) Foreign Application Priority Data

Mar. 1, 1996 (DE) ..... 196 07 800

(51) Int. Cl.[7] ..... C11D 7/06; C11D 3/30

(52) U.S. Cl. ..... 510/218; 510/219; 510/223; 510/225; 510/231; 510/233; 510/234; 510/477; 510/480; 510/510; 510/534; 510/252; 510/272; 510/531; 134/10; 134/22.13; 134/22.17; 134/22.18

(58) Field of Search ..... 510/218, 219, 510/223, 225, 231, 233, 234, 477, 480, 510, 534, 252, 272, 531; 134/10, 22.13, 22.17, 22.18

(56) References Cited

U.S. PATENT DOCUMENTS

| | | | | |
|---|---|---|---|---|
| 4,230,592 | * | 10/1980 | Miller et al. | 252/156 |
| 4,243,543 | * | 1/1981 | Guilbert et al. | 252/105 |
| 4,787,999 | * | 11/1988 | Dinges | 252/174.17 |
| 4,836,948 | * | 6/1989 | Corring | 252/99 |
| 4,906,396 | * | 3/1990 | Falholt et al. | 252/174.12 |
| 5,064,561 | * | 11/1991 | Rouillard | 252/174.12 |
| 5,093,031 | * | 3/1992 | Login et al. | 252/357 |
| 5,273,675 | * | 12/1993 | Lein et al. | 252/103 |
| 5,484,549 | * | 1/1996 | Hei et al. | 252/103 |
| 5,514,282 | * | 5/1996 | Hibbard et al. | 210/652 |
| 5,520,835 | * | 5/1996 | Sivik et al. | 252/102 |
| 5,562,829 | * | 10/1996 | Malcolm et al. | 210/667 |
| 5,679,633 | * | 10/1997 | Tseng | 510/499 |
| 5,710,120 | * | 1/1998 | Kanluen et al. | 510/421 |
| 5,746,920 | * | 5/1998 | Boergardts et al. | 210/611 |
| 5,770,555 | * | 6/1998 | Weinstein | 510/434 |
| 5,783,542 | * | 7/1998 | Rouillard | 510/234 |
| 5,786,313 | * | 7/1998 | Schneider et al. | 510/219 |

FOREIGN PATENT DOCUMENTS

| | | | |
|---|---|---|---|
| 42 06 772 | | 9/1993 | (DE) . |
| 195 24 211 | | 1/1997 | (DE) . |
| 0 551 245 | | 7/1993 | (EP) . |
| WO95/27681 | | 10/1995 | (WO) . |
| 95/35359 | * | 12/1995 | (WO) . |

OTHER PUBLICATIONS

R. Danziger: "Ein MembrantrennverFahren zur NaO-H–Rueckgewinnung" Fat Science Technology vol. 94, No. 10, 1992, Leinfelden, pp. 401–403, Abstract No. XP002011953.

L.P. Raman et al: "Consider Nanofiltration for Membrane Seperations"Chemical Engineering Progress, vol. 90, No. 3, Mar. 1994, pp. 68–74, Abstract No. XP000433566.

* cited by examiner

*Primary Examiner*—Yogendra Gupta
*Assistant Examiner*—Charles Boyer
(74) *Attorney, Agent, or Firm*—Wayne C. Jaeschke; Real J. Grandmaison; Glenn E.J. Murphy

(57) ABSTRACT

An aqueous alkaline composition for cleaning equipment used in the food industry wherein the composition contains potassium hydroxide or a mixture of potassium hydroxide and sodium hydroxide and wherein the potassium hydroxide is present in an amount of at least 20% by weight, based on the weight of hydroxide present in the composition. A process for regenerating the cleaning solution is also disclosed.

13 Claims, 1 Drawing Sheet

CLEANING AGENT FOR FOOD-INDUSTRY FACILITIES, ITS USE AND METHOD OF CLEANING SUCH FACILITIES USING THE AGENT

BACKGROUND OF THE INVENTION

1. Field of the Invention

This invention relates to a water-containing alkaline cleaning formulation containing potash lye for equipment used in the food industry.

The invention also relates to a process for cleaning equipment used in the food industry with an alkaline cleaning formulation which is regenerated by membrane filtration, the permeate being recycled.

It is known that equipment used in the food-processing industry, for example tanks, pipelines, bottling plants and the like, can be cleaned with alkaline cleaning solutions. These cleaning solutions or liquors essentially consist of a 2% soda lye containing added cleaning enhancers, for example defoamers and emulsifiers. In principle, potash lye could be used instead of soda lye because it produces the same cleaning result. However, soda lye is used for reasons of cost. Only where low outside temperatures prevail is potash lye added in small quantities to the soda lye in order to lower the crystallization point of the cleaning concentrate. However, the potash lye always makes up considerably less than 20% by weight of the hydroxide total.

The alkaline cleaning solutions often contain an addition of ethylenediamine tetraacetic acid (EDTA) in the form of its disodium salt because EDTA—as the only complexing agent in aqueous alkaline cleaning solutions—is capable of dissolving mineral soils, such as calcium and magnesium salts, for example in the form of limescale, milk scale, beer scale and the like.

In recent years, an integrated cleaning and disinfecting technique known as cleaning in place (CIP) has been successfully applied. The corresponding fully automatic cleaning systems clean all storage tanks and pipelines automatically after each production cycle. The cleaning formulation and cleaning process according to the invention are particularly suitable for use in the CIP process.

2. Discussion of Related Art

It is known that wastewater pollution by spent cleaning solutions can be reduced and the economy of the cleaning process improved by regenerating the spent cleaning solution in membrane filtration units. To this end, part of the cleaning solution is transferred from a collecting tank to a buffer tank and pump-circulated from there through a membrane system in which it undergoes crossflow filtration. One such regenerating process is known from WO 95/27681 A1. The permeate consisting of water and soda lye is returned to the collecting tank for the cleaning solution. The organic soils collect in the buffer tank of the membrane filtration unit and are periodically removed for disposal as waste. Since, in cases where EDTA-containing cleaning solutions are used, any introduction of EDTA into the wastewater should be avoided on account of the poor biodegradability of this compound and its ability to remobilize heavy metals in the environment, Israeli patent application IL 109 249 proposes recovering the EDTA from the concentrates collecting in the buffer tank by acidic precipitation. However, the addition of EDTA to the cleaning solutions affects the performance of the nanofiltration unit which is reflected in distinctly reduced flow. In addition, in the case of cleaning equipment for the dairy industry and in the case of EDTA-free cleaning solutions, it is known that the concentrate can be freed from the alkaline constituents by diafiltration and subsequently used as an animal feed or animal feed supplement. Diafiltration is necessary to reduce the sodium content of the concentrate which is too high for its use as an animal feed. Unfortunately, the large volume of wastewater accumulating in the diafiltration process and the high cost of diafiltration are disadvantages.

The problem addressed by the present invention was to provide an alkaline cleaning formulation and a process for cleaning equipment used in the food industry of the type mentioned at the beginning which would enable cleaning to be carried out far more economically than in the prior art.

DESCRIPTION OF THE INVENTION

In the case of the water-containing alkaline cleaning formulation, the solution to this problem as provided by the invention is characterized in that the cleaning formulation contains only potash lye or a mixture of potash lye and another alkali, more particularly soda lye, containing at least 20% by weight of potash lye, expressed as hydroxide and based on the total amount of hydroxide present in the cleaning formulation, as its hydroxide component.

In the case of the cleaning process according to the invention, the solution to the problem stated above as provided by the invention is characterized in that it is carried out with a cleaning solution of which the hydroxide component consists solely of potash lye or of a mixture of potash lye and another alkali, more particularly soda lye, containing at least 20% by weight of potash lye, expressed as hydroxide and based on the total amount of hydroxide present in the cleaning solution.

It has surprisingly been found that the partial or complete replacement of sodium hydroxide by potassium hydroxide increases the performance of the membrane unit by at least 10 to 50%. Performance in this case is based on the permeate flows achieved. Investment costs and the energy consumption of the membrane filtration unit can thus be reduced. Higher concentrations of the soil load removed are possible so that the volume of the soil load is reduced and the yield of regenerated solution is increased.

Another advantage was discovered. In contrast to the prior art where the concentrate obtained is a mass which is fairly solid at room temperature and which leads to problems during discharge from the buffer tank and during subsequent processing, the concentrate obtained where the cleaning formulation according to the invention is used and in the practical application of the process according to the invention is a mass containing the soils which is liquid at room temperature and even at a temperature of 0° C. On the one hand, this simplifies the waste logistics; on the other hand, greater concentration can be achieved, providing for a higher nutrient content where the concentrate is used as an animal feed and for a higher energy content where it is used as a fuel.

The advantages mentioned above were achieved with a minimum of only 20% by weight of potash lye, expressed as hydroxide and based on the total amount of hydroxide present in the cleaning formulation. The disadvantage of the higher cost of using potash lye instead of soda lye is negligible because the potash lye is largely regenerated.

In the nanofiltration of EDTA-containing cleaning solutions, the performance of the membrane filtration unit is likewise increased by replacement of the sodium salts by potassium salts. Disadvantages arising during filtration through the use of EDTA can thus be compensated or even overcompensated simply by using potash lye and EDTA in the form of the free acid or its potassium salt. The disodium salt of EDTA may also be used providing this does not increase the sodium ion content of the formulation beyond certain limits. If all alkali metal ions are counted as alkali metal hydroxide, the potash lye content of the cleaning formulation, based on the total amount of hydroxide present therein, should not fall below 20% by weight. Generally speaking, the performance of the filtration unit increases with the ratio of potassium to sodium ions in the cleaning formulation, i.e. sodium-free cleaning solutions produce the highest throughflow rates in $l/m^2h$.

The cleaning formulation preferably contains a mixture of potash lye and another alkali, preferably soda lye, containing at least 50% by weight of potash lye, expressed as hydroxide and based on the total amount of hydroxide present in the cleaning formulation.

The advantage of the EDTA-free cleaning formulation containing at least 50% by weight of potash lye lies in the possibility of directly using the soils filtered off without any aftertreatment as an animal feed, for example as a pig feed, because a high potassium salt content can be tolerated more readily than a high sodium salt content.

In one particularly preferred embodiment, the EDTA-free cleaning formulation contains potash lye alone as its hydroxide component. By virtue of its high content of potassium ions, the membrane filtration concentrate obtained in this case is a valuable animal feed supplement, particularly for pig feed.

Where the soils removed are to be used as an animal feed, it is also of advantage for the cleaning formulation to contain additives which are all suitable as animal feed supplements. Special physiologically safe cleaning enhancers of the type in question, which are not used in known cleaning formulations, include in particular phosphates, gluconates and/or approved food-quality defoamers and emulsifiers.

In another advantageous embodiment, the cleaning formulation contains additives present in the form of potassium salts in addition to the hydroxide components. On the one hand, the performance of the membrane filtration unit can be additionally increased in this case. A permeate flow of, for example, 50 $l/m^2h$ in the case of a conventional cleaning formulation based on soda lye can be increased to 70 $l/m^2h$ by replacing the soda lye with potash lye. If the cleaning formulation additionally contains potassium tripolyphosphate to enhance cleaning, the permeate flow additionally rises to 74 $l/m^2h$.

Another advantage of these additives present in the form of potassium salts is their particular suitability as an animal feed supplement.

As mentioned above, the cleaning formulation according to the invention may be used with advantage for food-processing equipment having a regeneration unit for spent cleaning solutions. The cleaning formulation is particularly preferred for cleaning dairy equipment because the concentrate obtained may be used without any further aftertreatment as an animal feed. There is generally no need for diafiltration or other additional working-up. Not only is there no need for expensive waste-disposal of the soils separated off, these "soils" actually constitute a new useful material. If, however, the high salt content is to be reduced by diafiltration, the filtration process may be carried out much more quickly and hence economically in the case of the cleaning formulation and cleaning process according to the invention.

The concentrates obtained in the nanofiltration of EDTA-containing cleaning solutions can be subjected to step-by-step acidification to recover the EDTA. If the concentrate is nonspecifically acidified (as described in Israeli patent application IL 109 249), almost all the dirt present in the concentrate is precipitated besides the EDTA. When the precipitated EDTA filtered off is redissolved with a lye, the dirt is also redissolved. If the resulting solution is added to the solution cleaned by nanofiltration, the degree of soiling prevailing before nanofiltration is virtually reestablished. By acidification in steps (fractional precipitation), most of the dirt can be precipitated before the precipitation point for EDTA. The precipitated dirt can then be removed by simple filtration. If the pH value of the filtered solution is further reduced, EDTA precipitates with a far lower content of residual soil. The EDTA filtered off can be reconverted into a soluble form with alkali and added, for example, to the nanofiltration permeate. Since EDTA remains to a certain extent both in the precipitated sludge and in the solution from which it was precipitated, 80 to 90% of the EDTA originally used can be recycled by this method. However, the dirt filtered off can no longer be used as an animal feed on account of its residual EDTA content.

Alkali-resistant nanofiltration membranes with a D value of 100 to 2,000 dalton are preferably used in the process according to the invention to regenerate the cleaning solution. Membranes such as these are permeable to molecules with a molecular weight up to the D value mentioned, but retain molecules with a higher molecular weight.

In one particular embodiment, the membrane filtration is carried out on the crossflow principle with a transmembranal pressure difference of 8 to 25 bar.

In another preferred embodiment of the process according to the invention, a cleaning solution containing only additives suitable as animal feed supplements besides the hydroxide components is used for cleaning dairy equipment and the membrane filtration concentrate obtained is used as an animal feed or animal feed supplement.

A concentrate with a particularly high potassium content is far more suitable for use as an animal feed, for example as a pig feed, than concentrates with high sodium contents. In another embodiment, therefore, the hydroxide components of the cleaning solution consist solely of potash lye.

The known cleaning process is described first in the following with reference to the accompanying drawing which is a simplified flow chart of a CIP cleaning system followed by a regeneration unit for the cleaning solution. The description of the known process is followed by some Examples which demonstrate the superiority of the process and cleaning formulation according to the invention to the prior art.

DESCRIPTION OF THE DRAWING

From a collecting tank 1 for the cleaning solution with a volume of 5 to 30 $m^3$, the solution which contains about 2% by weight of soda lye in the prior art and 2% by weight of potash lye according to the invention and which is heated to 60–70° C. is fed to the equipment (tanks, pipelines, etc. denoted by the reference numeral 2 in FIG. 1) to be cleaned. The cleaning solution is circulated.

The soils gradually collecting in the cleaning solution are removed in the regenerating section shown on the right of FIG. 1. To this end, part of the cleaning solution is transferred to the buffer tank 4 through a pipe 3. This part of the cleaning solution is circulated through a membrane module 6 by a pressure pump 5. The soils collecting and settling in the buffer tank 4 are periodically removed through a pipe 7. The permeate issuing from the membrane module is returned to the collecting tank 1 through the return pipe 8.

EXAMPLE 1 (COMPARISON EXAMPLE)

Figure 1:
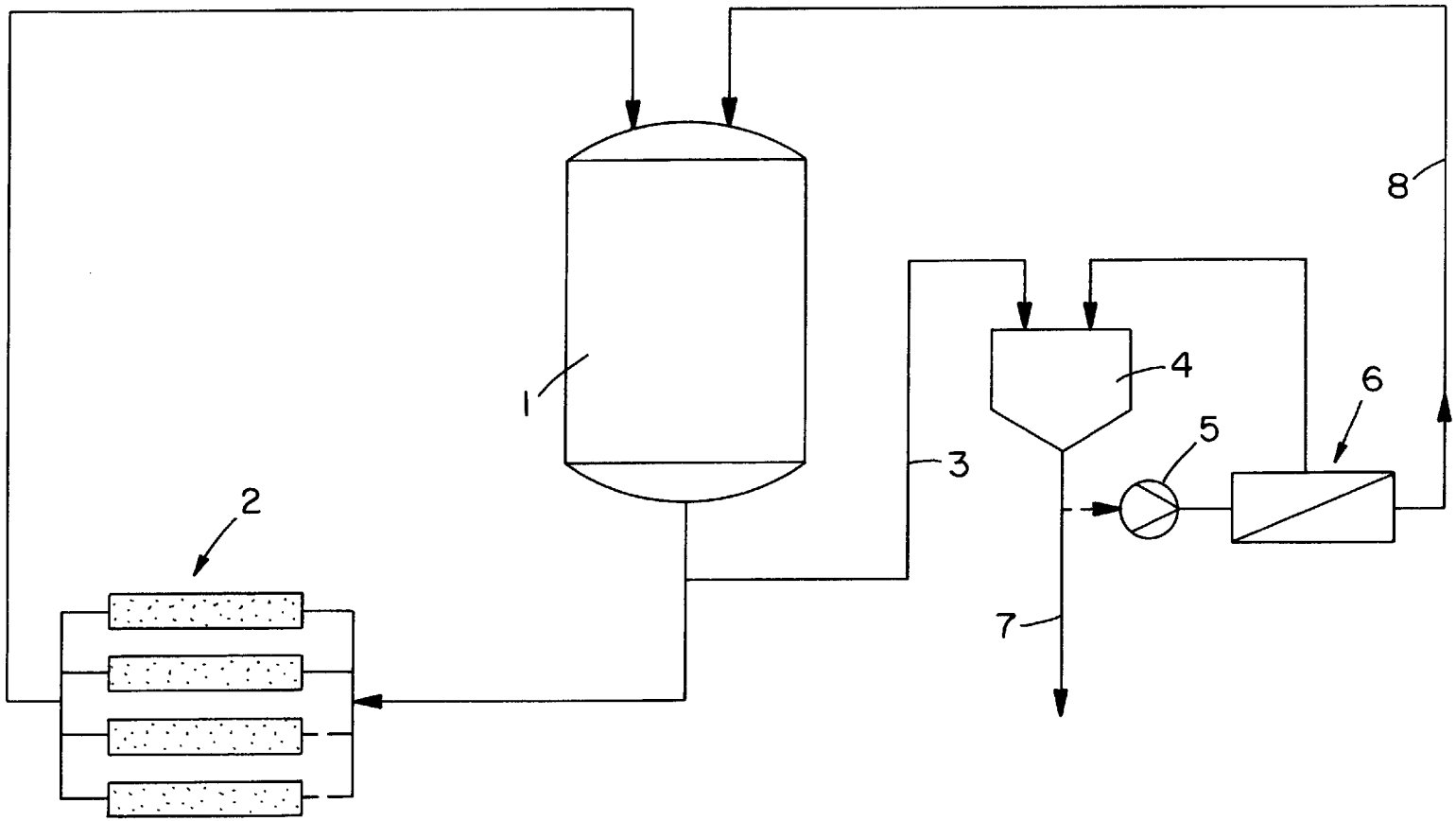

An artificially soiled solution corresponding to practical conditions with a temperature of 60 to 65° C. was used. It had been passed through a single-tube module with a membrane area of 0.042 $m^2$ and an MPT 34 nanofiltration membrane (a product of Membrane Products) for 75 to 120 mins. at a throughput of 1000 l/h (entry pressure 18 bar, exit pressure 14 bar). The permeate side of the membrane was at atmospheric pressure.

In the case of a cleaning solution containing only 2% soda lye, the permeate flow was 50 l/h $m^2$.

Where a cleaning solution containing only 2% potash lye was used, the permeate flow increased to 70 l/h $m^2$.

When 0.1% by weight of gluconic acid was added to the cleaning solution containing the potash lye, a permeate flow of 65 l/h $m^2$ was observed. When 0.25% by weight of potassium tripolyphosphate was added to the cleaning solution containing potash lye, a permeate flow of 73 to 75 l/h $m^2$ was observed.

These results reflect the clear superiority of the cleaning formulation and cleaning process according to the invention over the prior art because far higher performances were achieved. An additional advantage lies in the low sodium content of the concentrate obtained so that the concentrate may readily be used without further aftertreatment as an animal feed. In particular, there is no need for expensive diafiltration which is necessary in the known process in order to reduce the sodium content to tolerable levels.

EXAMPLE 2

An artificially soiled solution corresponding to practical conditions with a temperature of 60 to 65° C. and an EDTA content of 0.7% by weight was used. It had been passed through a single-tube module with a membrane area of 0.042 $m^2$ and an MPT 34 nanofiltration membrane (a product of Membrane Products) for 180 mins. at a throughput of 1000 l/h (entry pressure 18 bar, exit pressure 14 bar). The permeate side of the membrane was at atmospheric pressure.

In the case of a cleaning solution containing only 2% soda lye, the permeate flow was 50 l/h $m^2$.

When 0.7% by weight of EDTA was added to the cleaning solution containing the soda lye, a permeate flow of only 30 l/h $m^2$ was observed.

Where a cleaning solution containing only 2% potash lye was used, the permeate flow increased to 70 l/h $m^2$.

When 0.7% by weight of EDTA was added to the cleaning solution containing the potash lye, a permeate flow of 60 l/h $m^2$ was observed, i.e. a 20% improvement over the EDTA-free cleaning solution containing soda lye.

These results reflect the clear superiority of the cleaning formulation and cleaning process according to the invention over the prior art because far higher performances were achieved and were not as badly affected by the addition of EDTA as the known cleaning formulations and cleaning processes.

What is claimed is:

1. The process of cleaning equipment used in the food industry, comprising contacting said equipment with an aqueous alkaline composition containing potassium hydroxide or a mixture of potassium hydroxide and sodium hydroxide wherein said potassium hydroxide is present in an amount of at least 20% by weight, based on the weight of hydroxide present in said composition, regenerating said aqueous alkaline composition by membrane filtration with a nanofiltration membrane having a D value of 100 to 2,000 daltons to form a permeate, and recycling said permeate into the aqueous alkaline composition for contact with the food industry equipment.

2. A process as in claim 1 wherein said potassium hydroxide is present in an amount of at least 50% by weight, based on the weight of hydroxide present in said composition.

3. A process as in claim 1 wherein said composition contains only potassium hydroxide as the hydroxide.

4. A process as in claim 1 where in composition further contains cleaning components suitable for use as animal feed supplements.

5. A process as in claim 1 wherein said composition further contains phosphates, gluconates and food-quality defoamers and emulsifiers.

6. A process as in claim 1 wherein said composition further contains cleaning components in the form of potassium salts.

7. A process as in claim 1 wherein said composition further contains ethylenediamine tetraacetic acid or salts thereof.

8. A process as in claim 7 wherein said ethylenediamine tetraacetic acid is present as a potassium salt.

9. A process as in claim 7 wherein said ethylenediamine tetraacetic acid is present as the disodium salt and said potassium hydroxide is present in an amount of at least 20% by weight, based on the weight of hydroxide present in said composition.

10. A process as in claim 1 wherein said food industry equipment comprises dairy equipment.

11. A process as in claim 1 wherein said membrane filtration is conducted by crossflow filtration at a transmembranal pressure difference of 8 to 25 bar.

12. A process as in claim 1 wherein the membrane filtration concentrate obtained is useful as an animal feed or animal feed supplement.

13. A process as in claim 1 wherein ethylenediamine tetraacetic acid or salts thereof obtained from said regenerating step is recovered by fractional precipitation, dissolved with alkali metal hydroxide, and returned to said aqueous alkaline composition.

* * * * *